US006076807A

United States Patent [19]

Spence

[11] Patent Number: 6,076,807

[45] Date of Patent: Jun. 20, 2000

[54] FENCE OR DECK POST CAP

[76] Inventor: Jonathan P. Spence, 217 N. Broad St., Grove City, Pa. 16127

[21] Appl. No.: 09/114,728

[22] Filed: Jul. 13, 1998

Related U.S. Application Data

[60] Provisional application No. 60/052,641, Jul. 16, 1997.

[51] Int. Cl.[7] ..... E04H 17/00

[52] U.S. Cl. ..... 256/1; 256/19

[58] Field of Search ..... 256/1, 19, 59, 256/65, 66, 32, 47

[56] References Cited

U.S. PATENT DOCUMENTS

| | | | |
|---|---|---|---|
| 438,122 | 10/1890 | Thorp | 256/48 |
| 4,103,875 | 8/1978 | Glass | 256/59 |
| 4,361,314 | 11/1982 | Ohlson | 256/65 |
| 4,722,514 | 2/1988 | Pettit | 256/50 |
| 5,078,367 | 1/1992 | Simpson et al. | 256/19 X |
| 5,421,556 | 6/1995 | Dodge et al. | 256/1 |
| 5,645,270 | 7/1997 | Lawrence | 256/19 X |
| 5,755,431 | 5/1998 | Williams | 256/19 |
| 5,853,167 | 12/1998 | West et al. | 256/19 X |
| 5,927,694 | 7/1999 | Montepiano | 256/19 X |
| 5,931,450 | 8/1999 | Yoder | 256/59 |

FOREIGN PATENT DOCUMENTS

| | | | |
|---|---|---|---|
| 3440160 | 5/1986 | Germany | 256/19 |
| 8400058 | 8/1985 | Netherlands | 256/24 |
| 3725 | 12/1868 | United Kingdom | 256/1 |
| 2436 | 6/1985 | WIPO | 256/65 |

OTHER PUBLICATIONS

Catalog sheets from LMT Products Corp., LMT Products Division, Price List dated Dec. 1, 1995.

*Primary Examiner*—Harry C. Kim
*Attorney, Agent, or Firm*—Webb Ziesenheim Logsdon Orkin & Hanson, P.C.

[57] ABSTRACT

A fence or deck post cap has a base defining a recessed portion and having interior sides. The cap also includes an upper cap portion with a depending rod. The rod is receivable in the recessed portion of the base. Wedges are provided on each interior side of the base for engaging the sides of a post and to stably fit the cap to the post. The base of the cap is secured to the post with a fastener or an adhesive.

18 Claims, 4 Drawing Sheets

FENCE OR DECK POST CAP

CROSS REFERENCE TO RELATED APPLICATION

This application claims the benefit of U.S. Provisional Application Ser. No. 60/052,641 filed Jul. 16, 1997, entitled "Fence Post Cap".

BACKGROUND OF THE INVENTION

1. Field of the Invention

The present invention relates to caps for fastening to the tops of fence or deck posts and, more particularly, to caps made of plastic.

2. Description of the Prior Art

It is known to make fence or deck post caps from wood or PVC resin with a UV stabilizer. A problem with wooden caps is that they often disintegrate over time when exposed to weather. Another drawback with both existing wood and plastic caps is the way such caps are typically mounted to fence and deck posts. Prior art caps are typically made as a single piece which is screwed into the top of the post and centered by the eyesight of the installer. The cap and the post must typically be made by the same manufacturer in order for the cap to snugly and evenly fit on the top of the post. These sizing problems are encountered because post manufacturers make posts having variations in wall thickness. These variations in wall thickness are due to the different extrusion tolerances and varying post product lines present among the different fence post manufacturers.

It would therefore be advantageous to provide a cap made of plastic which is not susceptible to deterioration caused by weather. It would also be advantageous to equip the cap with means for fitting the cap evenly on top of a fence or deck post despite differences in tolerance from one post to another. It would also be desirable to provide a mechanism to ensure that the parting lines on the cap are properly aligned when installed.

It is therefore an object of this invention to provide an improved fence or deck post cap which is durable, easy to properly assemble and install, and which fits on a post in a manner which compensates for varying post thicknesses and tolerances.

SUMMARY OF THE INVENTION

The present invention relates to a fence or deck post cap which includes a base having a recessed portion and downward extending sidewalls; a cap portion having an upper cap portion and a rod depending from the upper cap portion, the rod being receivable in the recessed portion of the base; and wedges on an interior of each sidewall of the base.

The cap portion comprises a first half and a second half and means for joining the two halves together (for example, by a snap fit). The base preferably has three wedges on the interior of each sidewall, and the rod is fastened in the recessed portion of the base by means of glue or the like. The recessed portion of the base has an outer edge which is shaped substantially as a circle and has a first flat section on the outer edge. The rod of the cap portion has a second flat section which engages with the first flat section to provide a key for restricting rotational movement of the rod in the base and to set the parting lines on the cap appropriately. The fence or deck post cap further has means for fastening the base to the top of a post. The upper cap portion may be shaped as a tear drop, a ball, a diamond or any other desired shape. The fence or deck post cap is made out of plastic.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENTS

Figure 1:
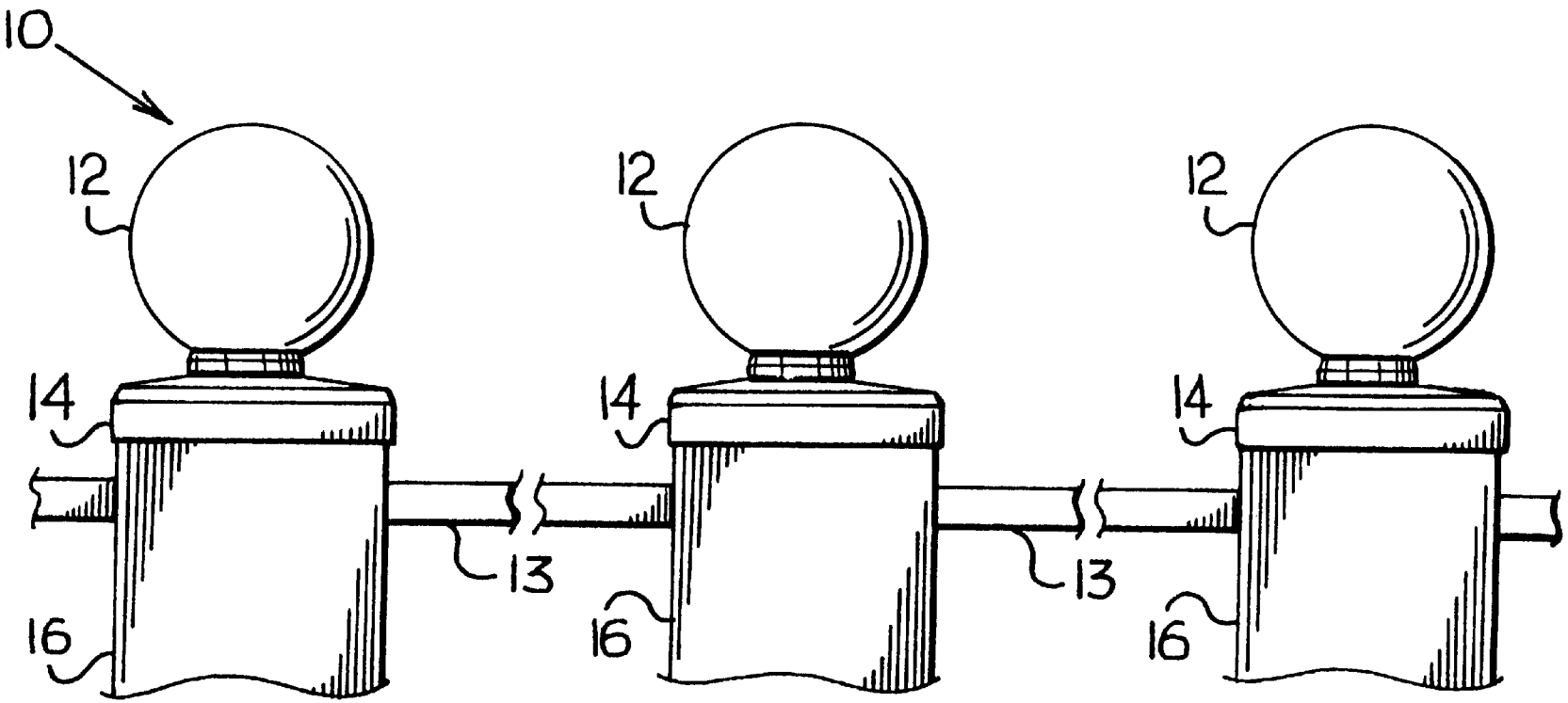
FIG. 1 is a front view of three caps attached to posts according to the invention.

Referring to FIG. 1, a cap 10 for a fence or deck post is made of plastic, preferably vinyl PVC, and comprises a cap portion 12 fastened to a base 14. The plastic cap 10 is durable and is not susceptible to deterioration due to weather effects, as is the case with prior art fence or deck post caps, made of wood or other materials.

Figure 2:
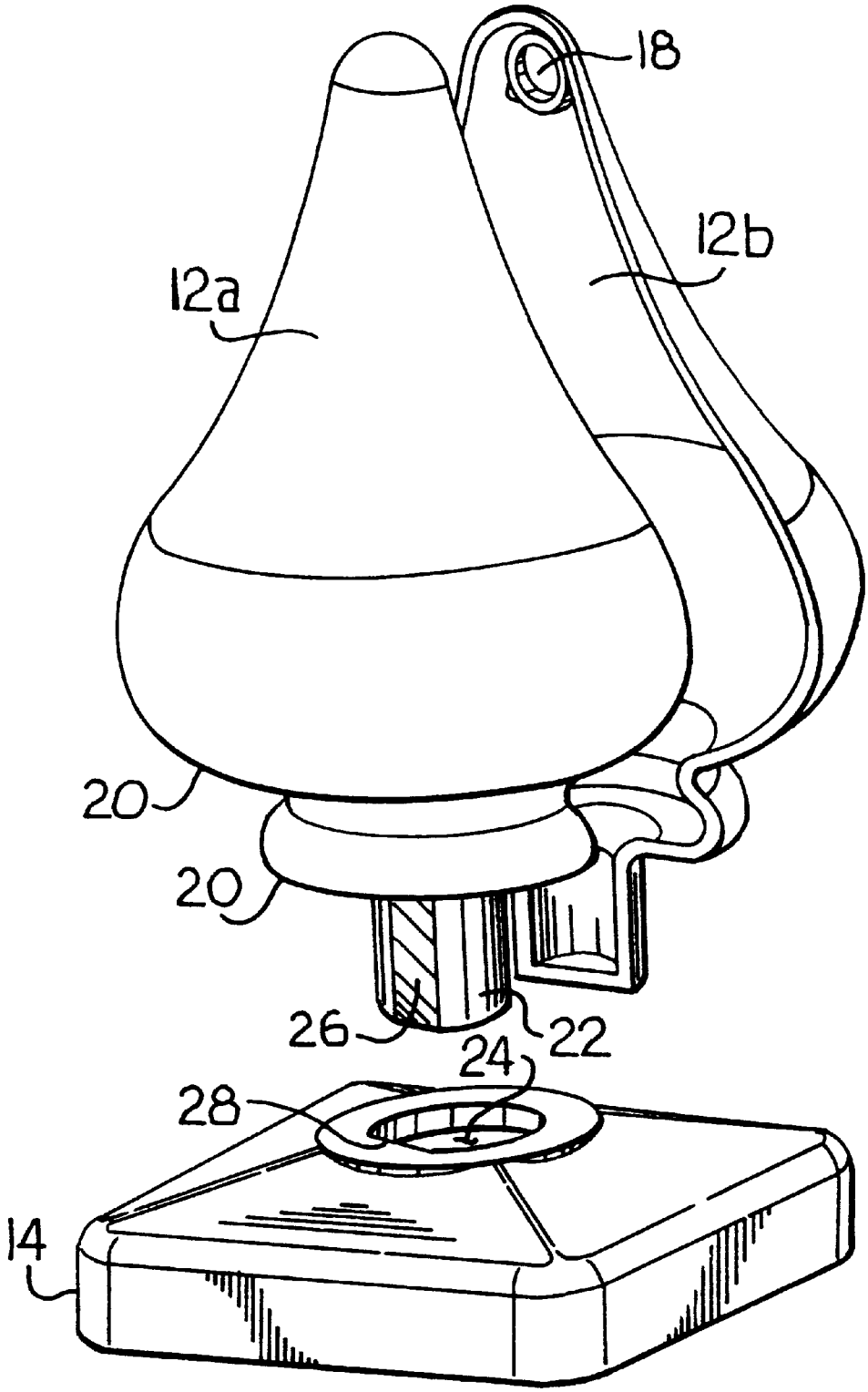
FIG. 2 is an exploded perspective view showing how a cap, according to the invention, snaps together and is fitted into a base.

As shown in FIG. 2, the cap portion 12 comprises two halves 12*a*, 12*b* which are connected by a snap 18 creating a parting line at the joint between the two halves. When properly installed, the parting line is parallel with the length of the fence or deck 13 to provide uniformity and promote the appearance of solid fence or deck post caps, despite the two-part construction.

The cap portion 12 further comprises an upper cap portion 20 and a rod 22. The upper cap portion 20 may be shaped as a tear drop, a diamond, a ball or any other desired shape. The rod 22 is substantially circular and is received in and glued to a recessed portion 24 in the center of the base 14. The rod 22 and the recessed portion 24 are both notched with flat sections 26, 28 in order to prevent rotational movement of the rod 22 in the recessed portion 24. The flat portions 26, 28 also provide a key to ensure the installer sets the parting lines of the cap 10 in parallel alignment with the direction of the fencing (or decking) 13.

Figure 3:
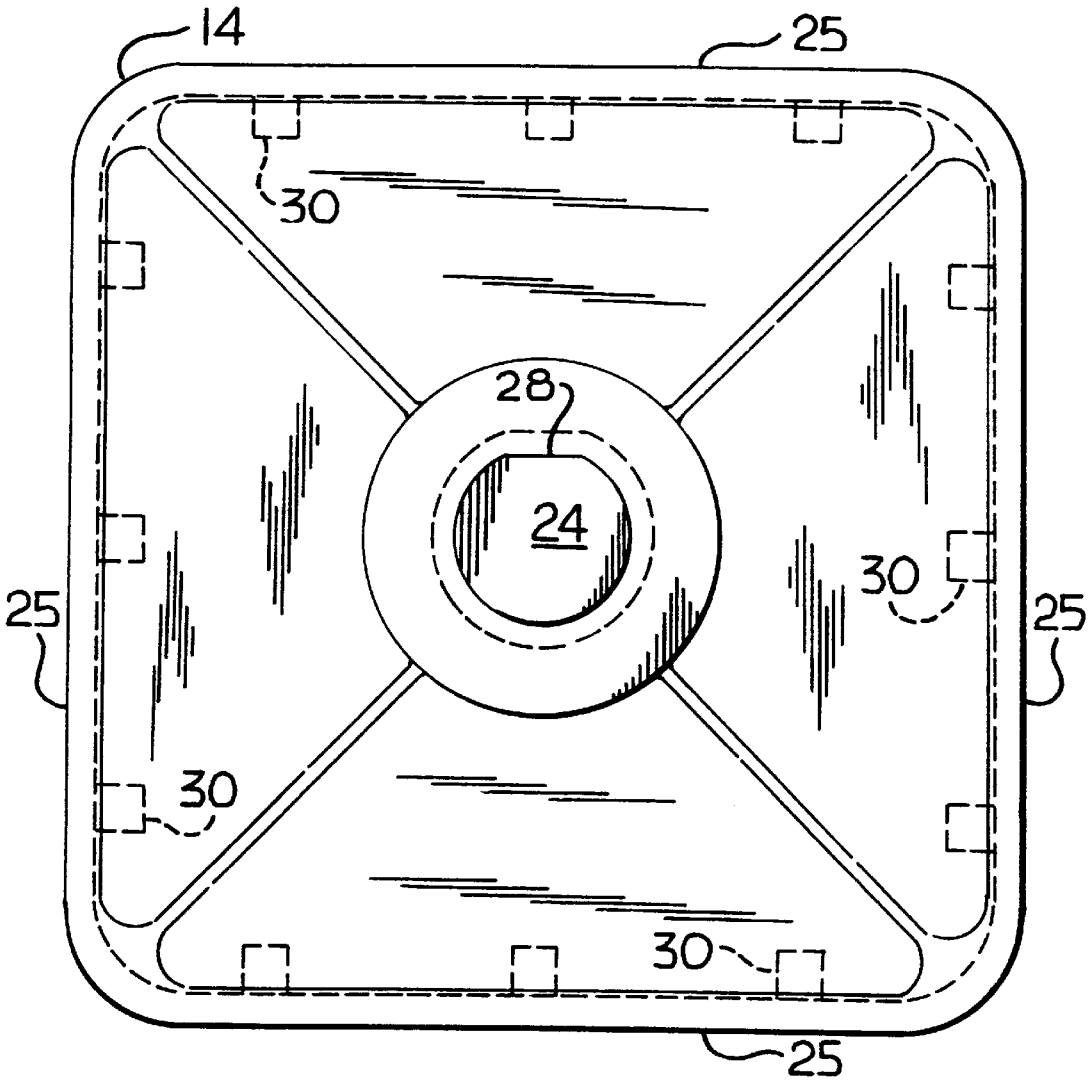
FIG. 3 is a plan view of the base of FIG. 2.

FIG. 3 is a plan view of the base 14 and shows the flat section 28 on the outer edge of the recessed portion 24. Three wedges 30 are located on the interior of each sidewall 25 of the base 14. The wedges 30 are preferably on the order of ⅛ to ¼ inch wide. The wedges 30 serve as shims of gradually increasing thicknesses to allow the base 14 to fit on varying posts 16, despite differences in thickness and tolerances, caused by the extrusion process in making plastic posts, or due to the use of posts from different manufacturers.

Figure 4:
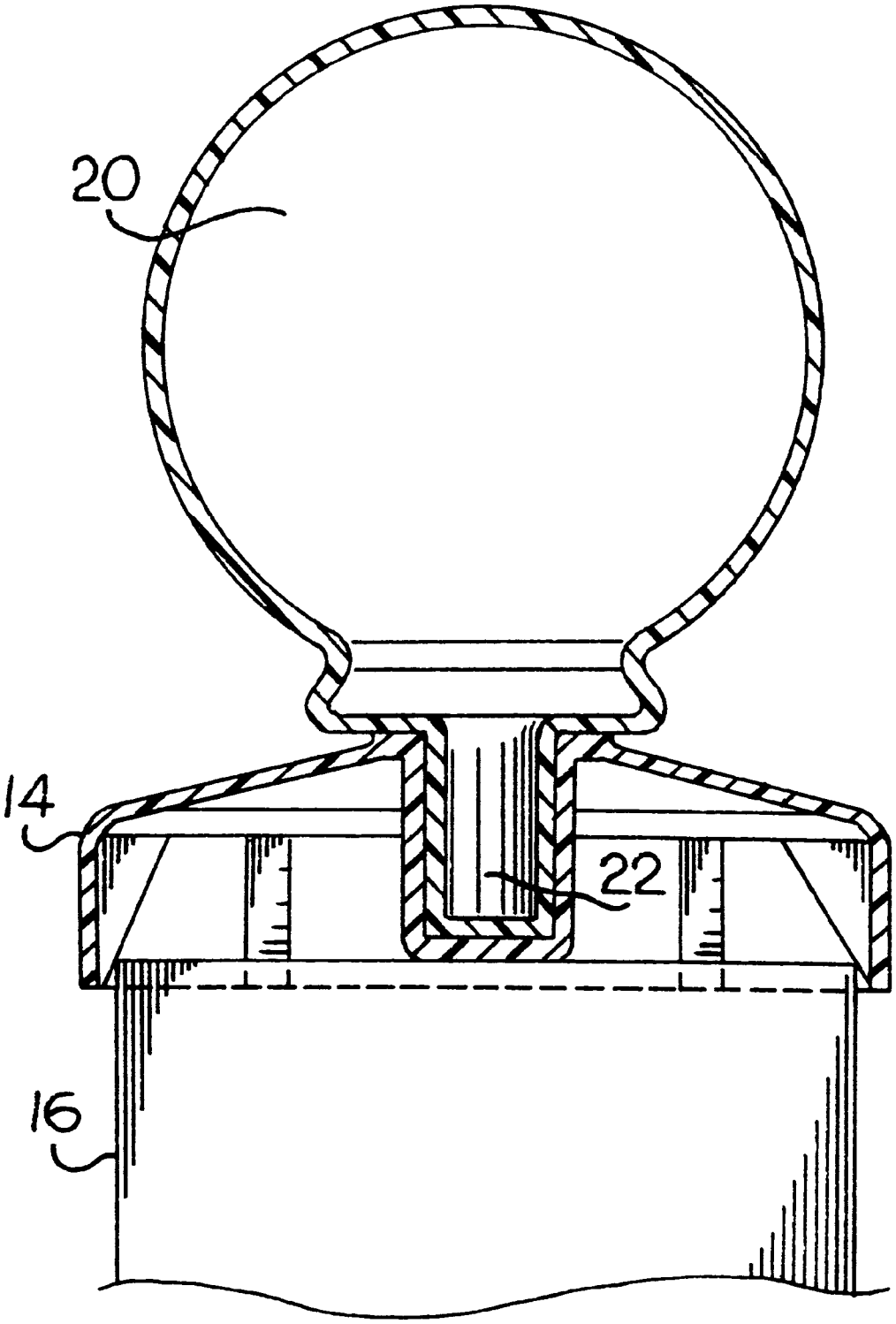
FIG. 4 is a cross-sectional view showing a cap fitted into a base, the base being screwed into a post.

FIG. 4 depicts the cap portion 12 inserted in the base 14 in cross-section. The base 14 is snugly and evenly fitted over the post 16 through contact of the wedges 30 on the outer, upper edges of the post 16. The base 14 is fastened to the post 16 by means of glue placed on the inside surfaces of the base 14, or by screws extended through the sidewalls 25 of the base 14.

The present invention thus provides an improved fence or deck post cap with enhanced durability and the capability to fit posts of varying thicknesses and tolerances. The fence or deck post cap of the present invention also provides a built-in mechanism for properly aligning the cap to maximize its aesthetic appeal. An installer may quickly and efficiently install the base and cap portion of the present invention, without relying solely on his or her eyesight to properly align the cap.

Having described the presently preferred embodiments and best mode of the invention, it will be apparent to those skilled in the art that certain variations and modifications may be made without departing from the spirit and scope of the invention.

I claim:

1. A fence or deck post cap, comprising:

a base defining a recessed portion and having interior sides;

a cap portion having an upper cap portion and having a rod depending from the upper cap portion, the rod being receivable in the recessed portion of the base;

a plurality of wedges on each interior side of the base, wherein the cap portion includes a first vertical half and a second vertical half; and means for joining the two vertical halves together.

2. The fence or deck post cap as described in claim 1, wherein the base has three wedges on each interior side for stably fitting the cap to a post.

3. The fence or deck post cap as described in claim 1, wherein the rod is fastened to the recessed portion of the base by means of glue.

4. The fence or deck post cap as described in claim 1, wherein:

the recessed portion of the base has an outer edge which is shaped substantially as a circle and has a first flat section on the outer edge; and wherein the rod of the cap portion has a second flat section co-acting with the first flat section to provide a means for restricting swiveling movement of the rod in the base.

5. The fence or deck post cap as described in claim 1, having a means for fastening the base to a post.

6. The fence or deck post cap as described in claim 5, wherein the fastening means is a screw.

7. The fence or deck post cap as described in claim 5, wherein the fastening means is an adhesive.

8. The fence or deck post cap as described in claim 1, wherein the upper cap portion is shaped as a tear drop.

9. The fence or deck post cap as described in claim 1, wherein the upper cap portion is shaped as a ball.

10. The fence or deck post cap as described in claim 1, wherein the fence or deck post cap is made of plastic.

11. A fence or deck post cap, comprising:

a base defining a recessed portion and having interior sides;

a cap portion having an upper cap portion and having a rod depending from the upper cap portion, the rod being receivable in the recessed portion of the base; and a plurality of wedges on each interior side of the base, wherein the recessed portion of the base has an outer edge which is shaped substantially as a circle and has a first flat section on the outer edge, and wherein the rod of the cap portion has a second flat section co-acting with the first flat section to provide a means for restricting swiveling movement of the rod in the base.

12. The fence or deck post cap as described in claim 11, wherein the cap portion comprises a first vertical half and a second vertical half, and a means for snapping the two vertical halves together.

13. The fence or deck post cap as described in claim 11, wherein the base has three wedges on each interior side for stably fitting the cap to a post.

14. The fence or deck post cap as described in claim 11, wherein the rod is fastened to the recessed portion of the base by means of glue.

15. The fence or deck post cap as described in claim 11, wherein the fence or deck post cap is made of plastic.

16. The fence or deck post cap as described in claim 11, wherein the base is adapted to be fastened to a post with at least one screw.

17. The fence or deck post cap as described in claim 11, wherein the base is adapted to be fastened to a post with an adhesive.

18. A method of installing a cap on a fence or deck post comprising the steps of:

providing said cap having a base, a cap portion and a plurality of wedges, the base defining a recessed portion and having interior sides, the cap portion having an upper cap portion and a rod depending from the upper cap portion, the cap portion divided into a first vertical half and a second vertical half, the wedges being located on each of the interior sides of the base;

joining the first vertical half and the second vertical half of the cap portion together;

securing the rod of the cap portion in the recessed portion of the base so that rotational movement of the rod in the base is prevented;

placing the base of the cap onto the top of a post so that the wedges engage the sides of the post and stably fit the cap to the post; and securing the base of the cap to the post with a fastening means.

* * * * *